US012135132B2

(12) United States Patent
Yungbluth

(10) Patent No.: US 12,135,132 B2
(45) Date of Patent: Nov. 5, 2024

(54) GRATE AND RANGE SYSTEM

(71) Applicant: Middleby Marshall Inc., Elgin, IL (US)

(72) Inventor: Christian Matthew Yungbluth, Fuquay-Varina, NC (US)

(73) Assignee: Middleby Marshall Inc., Elgin, IL (US)

( * ) Notice: Subject to any disclaimer, the term of this patent is extended or adjusted under 35 U.S.C. 154(b) by 812 days.

(21) Appl. No.: 17/332,204

(22) Filed: May 27, 2021

(65) Prior Publication Data

US 2021/0285658 A1 Sep. 16, 2021

Related U.S. Application Data

(63) Continuation of application No. 16/431,465, filed on Jun. 4, 2019, now Pat. No. 11,047,580.

(51) Int. Cl.
*F24C 15/10* (2006.01)

(52) U.S. Cl.
CPC ..... *F24C 15/107* (2013.01)

(58) Field of Classification Search
CPC ..... F24C 15/107
See application file for complete search history.

(56) References Cited

U.S. PATENT DOCUMENTS 1,738,297 A * 12/1929 Hoffman ..... F24C 15/107 29/894.343
1,896,082 A * 2/1933 Harper ..... F23D 14/64 126/39 N
1,922,420 A * 8/1933 Coulston ..... F24C 15/10 126/215
2,187,169 A * 1/1940 Mills ..... F24C 3/106 431/193
2,285,278 A * 6/1942 Hennessy ..... F24C 15/107 126/214 C
2,385,278 A 6/1942 Hennessy
2,298,307 A * 10/1942 Parker ..... F24C 3/085 126/39 H (Continued)

FOREIGN PATENT DOCUMENTS

CN 109458629 A 3/2019
CN 109458639 A * 3/2019 ..... F24C 15/107
JP 2002221325 A * 8/2002

OTHER PUBLICATIONS

Partstown, "Vulcan Hart 00-957369-00001 Grate, 12 Rear," 2019, 2 pages, Retrieved at <https://www.partstown.com/vulcan-hart/vh00-957369-00001> on Oct. 18, 2019.

(Continued)

*Primary Examiner* — Jorge A Pereiro
(74) *Attorney, Agent, or Firm* — Crowell & Moring LLP

(57) ABSTRACT

Individual grates and a multi-grate system for a cooking range include construction of the tangs and nubs of each grate are aligned with each other in a manner providing a non-contiguous surface along a common plane. The common plane is provided by the uppermost surfaces of the tangs and nubs upon which the bottom of a cooking vessel (e.g., stock pot, skillet, saucepan, griddle, etc.) rests, with the relative position providing that a five-inch diameter bottom surface of the cooking vessel will contact the common plane sufficiently to substantially prevent tipping.

19 Claims, 13 Drawing Sheets

(56) References Cited

U.S. PATENT DOCUMENTS 2,320,754 A * 6/1943 Sherman ..... F23D 14/06 126/39 K
2,430,079 A * 11/1947 Reeves ..... F24C 15/10 126/214 C
2,480,046 A * 8/1949 Reeves ..... F24C 15/10 126/214 C
2,571,741 A * 10/1951 Mayer ..... F24C 15/107 126/214 C
2,594,215 A * 4/1952 Resek ..... F24C 15/107 126/211
3,369,537 A * 2/1968 Young, Jr. ..... F24C 15/107 126/215
3,442,261 A * 5/1969 Berlik ..... F24C 15/107 126/215
4,089,321 A * 5/1978 Ondrasik ..... F24C 15/107 126/215
D458,803 S * 6/2002 Becker ..... F24C 15/107 D7/408
D468,964 S * 1/2003 Becker ..... F24C 15/107 D7/408
D486,690 S * 2/2004 Becker ..... F24C 15/107 D7/408
D495,557 S * 9/2004 Shin ..... F24C 15/107 D7/346
D495,924 S * 9/2004 Becker ..... F24C 15/107 D7/346
D505,825 S * 6/2005 Vetter ..... F24C 15/107 D7/340
6,935,330 B1 8/2005 Barrero
D524,601 S * 7/2006 Vetter ..... F24C 15/107 D7/408
D550,055 S 9/2007 Pino
D550,505 S * 9/2007 Pino ..... D7/408
D628,431 S * 12/2010 Funnell ..... D7/346
D634,579 S * 3/2011 Funnell, II ..... D7/346
D702,496 S * 4/2014 Funnell, II ..... D7/408
D702,497 S * 4/2014 Funnell, II ..... D7/408
D704,509 S * 5/2014 Funnell, II ..... D7/408
D798,661 S * 10/2017 Shoemaker ..... D7/408
D903,412 S * 12/2020 Nilssen ..... D7/408
2003/0051724 A1* 3/2003 Rummel ..... F24C 3/085 126/211
2003/0079739 A1* 5/2003 Jones ..... F24C 15/107 126/215
2004/0069297 A1* 4/2004 Cadima ..... F24C 15/107 126/214 C
2004/0177844 A1* 9/2004 Rummel ..... F24C 3/085 126/214 C
2005/0161037 A1* 7/2005 Rummel ..... F24C 15/107 126/211
2008/0202493 A1* 8/2008 Dettloff ..... F24C 3/12 126/39 B
2009/0064987 A1 3/2009 Cadima
2010/0005976 A1* 1/2010 Inzaghi ..... F24C 3/085 126/39 E
2011/0041831 A1* 2/2011 Dettloff ..... F24C 3/12 126/39 B
2011/0120446 A1* 5/2011 Simms ..... F24C 15/107 126/39 E
2012/0012098 A1* 1/2012 Berr ..... F24C 15/107 126/39 B
2012/0048258 A1* 3/2012 Sewell ..... F24C 15/107 126/152 A
2014/0027439 A1* 1/2014 Bach ..... A21B 1/22 219/412
2017/0023254 A1* 1/2017 Cadima ..... A47J 37/049
2017/0261211 A1* 9/2017 Paitchell ..... F24C 15/107
2018/0112869 A1* 4/2018 Cadima ..... F24C 15/107
2018/0142898 A1* 5/2018 Cadima ..... F24C 15/107
2019/0195505 A1* 6/2019 Sloyer ..... F24C 15/107
2019/0226684 A1* 7/2019 Sloyer ..... F24C 15/107
2019/0309953 A1* 10/2019 Cadima ..... F24C 3/126
2019/0383497 A1* 12/2019 Cowan ..... F24C 15/107
2020/0370758 A1* 11/2020 Cusimano ..... F24C 3/126
2022/0325899 A1* 10/2022 Bierbaum ..... F24C 15/107

OTHER PUBLICATIONS

Partstown, Listing of Partstown "Southbend Range Grates,"201 9, 6 pages, Retrieved from <https://www.partstown.com/southbend-range/grates/parts?page=1>, on Oct. 11, 2019.
Southbend, "The Ultimate Heavy Duty Restaurant Range" flyer, Dec. 2015, 1 page.

* cited by examiner

GRATE AND RANGE SYSTEM

CROSS-REFERENCE TO RELATED APPLICATIONS

This application is a continuation application which claims priority under 35 USC § 120 to U.S. application Ser. No. 16/431,465, filed Jun. 4, 2019, which is incorporated by reference herein in its entirety.

TECHNICAL FIELD

Embodiments disclosed herein generally relate to grates used on a gas-heated cooking range, as well as a multi-grate system for a range or other cooktop.

BACKGROUND

Gas cooking ranges are well known for home and commercial kitchens. Many different configurations are known in the art, but a couple of major designs predominate. The first is shown in FIG. 1, which includes a plurality of grates 102 that together form a set of surfaces to hold, cooking vessels—e.g., pans and pots on a gas range 100. Each grate 102 includes one or more fingers or tangs 104 that extend from a proximal rim 106 distally in and centrally toward and/or across a burner element 140 that extends up through an aperture 122 in the bowl 118 of the grate 102. The grates 102 typically may readily be removed for cleaning, repair, or replacement. In a second configuration, shown in FIG. 2, one or more grates 202 include fingers 204 that form a relatively continuous set of surfaces to hold, e.g., pans and pots on a gas range 200. The fingers 204 configured as shown in FIG. 2 allow for use of smaller pots or pans, but block much more of the heated air flow from the burner elements 240 and are less efficient with regard to the amount of heat (e.g., in BTUs) transferred to cooking vessels per unit of gas being burned.

In contrast, configurations like that shown in FIG. 1 provide more effective and efficient heat transfer via convective air flow from the burner elements 140. However, the lower solid-covered area to open surface area ratio provided by this traditional type of configuration means that larger cooking vessels generally must be used to maintain at least three points of contact, and/or two lines of contact between the bottom of the cooking vessel and the tangs 104. If a cooking vessel is not provided with that contact, it will tip, such as shown by a cooking vessel 355 in FIG. 3. Such tipping can result in uneven heating/cooking, and/or spilling contents of the cooking vessel. As a result, care must be exercised, and cooking vessels must be carefully positioned across the distal portions of the tangs to avoid tipping, with many regions near the proximal ends of the tangs not providing support sufficient to prevent tipping. The grates may vary in size, but typically are 10-inch, 12-inch or larger squares or rectangles having at least one length or width dimension of ten inches or more. As such, the risk of tipping is particularly acute for smaller cooking vessels such as a kitchen-standard 7-inch-diameter and 4-inch-diameter skillets, which typically have, respectively, 5-inch-diameter and 3-inch-diameter bottom contact surfaces. It will be appreciated with reference to FIG. 3 that placing the pan 355 anywhere other than across the distal/central ends of two adjacent tangs will result in it tipping. The relative positions and spacing of tangs in a standard configuration where they project inwardly toward the burner means that those 7-inch-diameter and 4-inch-diameter skillets have only a very few positions where they will sit securely without tipping more than a few degrees (e.g., about 10 degrees). The manner this is typically addressed is by using a more-continuous grate configuration such as a grid, radial tangs that extend and connect across the burner(s), and/or a set of continuous parallel rods, for example of the types shown in FIG. 2, which includes both straight-line and sinuous parallel rods. These are very stable, but they are not as efficient at heating cooking vessels on the surface due both to blocking convection from gas burners and heat loss to the grate itself.

Accordingly, it is desirable to provide a grate that, on its own and assembled with other grates on a range, provides both the heating advantages of the traditional configuration shown in FIG. 1 and the ability to stably and securely place and move a small-diameter cooking vessel with little or no likelihood of tipping.

BRIEF SUMMARY

In one aspect, embodiments disclosed herein may include a first grate for a cooking range, said grate including a bowl with a rectilinearly-bounded border region which border is at least ten inches long or wide; a set of eight tangs protruding upward from and extending distally from the border region generally toward a central region above the bowl; and a set of at least six nubs protruding upward from the border region and disposed alternatingly between at least six of the eight tangs; where an uppermost surface of each of the tangs and an uppermost surface of each of the nubs together forms a non-contiguous surface along a common plane that is disposed above the bowl including the border region of the bowl; wherein the uppermost surfaces of the tangs and the nubs are configured and disposed in proximity to each other such that a five-inch diameter planar circle is positionable anywhere upon said uppermost surfaces in a manner preventing tipping by maintaining at least three points of contact, at least two lines of contact, at least one point and at least line of contact, or any other combination of points and/or lines of contact, so that the five-inch diameter planar circle remains at least substantially coplanar with the common plane; wherein the entire uppermost surface of at least one of the tangs or at least one of the nibs is narrower than its lowermost surface, thereby providing a tapered transverse sectional profile for said at least one of the tangs or at least one of the nubs; and wherein the distal end of at least one of the tangs is narrower than the proximal end of the tang.

In one aspect, embodiments disclosed herein may include a first grate for a cooking range, said grate including a bowl with a rectilinearly-bounded border region which border is at least ten inches long or wide; a set of eight tangs protruding upward from and extending distally from the border region generally toward a central region above the bowl; and a set of at least six nubs protruding upward from the border region and disposed alternatingly between at least six of the eight tangs; where an uppermost surface of each of the tangs and an uppermost surface of each of the nubs together forms a non-contiguous surface along a common plane that is disposed above the bowl including the border region of the bowl; and wherein the uppermost surfaces of the tangs and the nubs are configured and disposed in proximity to each other such that a five-inch diameter planar circle is positionable anywhere upon said uppermost surfaces in a manner preventing tipping by maintaining at least three points of contact, at least two lines of contact, at least one point and at least line of contact, or any other combination of points and/or lines of contact, so that the five-inch diameter planar circle remains at least substantially coplanar with the common plane.

In another aspect, embodiments disclosed herein may include a multi-grate range, such as—for example—a gas cooking range including burners, with a plurality of grates as described and/or illustrated herein.

In certain embodiments, the uppermost surface of at least one tang or at least one nub is narrower than its lowermost surface, thereby providing a tapered transverse sectional profile for said at least one tang or at least one nub.

In further embodiments, a multi-grate system for a gas cooking range includes a plurality of grates with each grate having at least one edge abutting at least one edge of another grate; wherein at least a first grate and a second grate of the plurality of grates each includes: a bowl including a rectilinearly-bounded border region outwardly defining the edges of each grate; a set of eight tangs protruding upward from and extending distally from the border region generally toward a central region above the bowl; and a set of at least six nubs protruding upward from the border region and disposed alternatingly between at least six of the eight tangs; where an uppermost surface of each of the tangs and an uppermost surface of each of the nubs are aligned so as to form a non-contiguous surface along a common plane that is disposed above the bowl; and wherein the uppermost surfaces of the tangs and the uppermost surfaces of the nubs are configured and disposed in proximity to each other such that a five-inch diameter planar circle is positionable anywhere upon said uppermost surfaces in a manner preventing tipping by maintaining at least three points of contact, two lines of contact, a point and a line of contact, or any combination thereof, so that the five-inch diameter planar circle remains at least substantially coplanar with the common plane in any position atop the uppermost surfaces of the plurality of grates.

DETAILED DESCRIPTION

Figure 1:
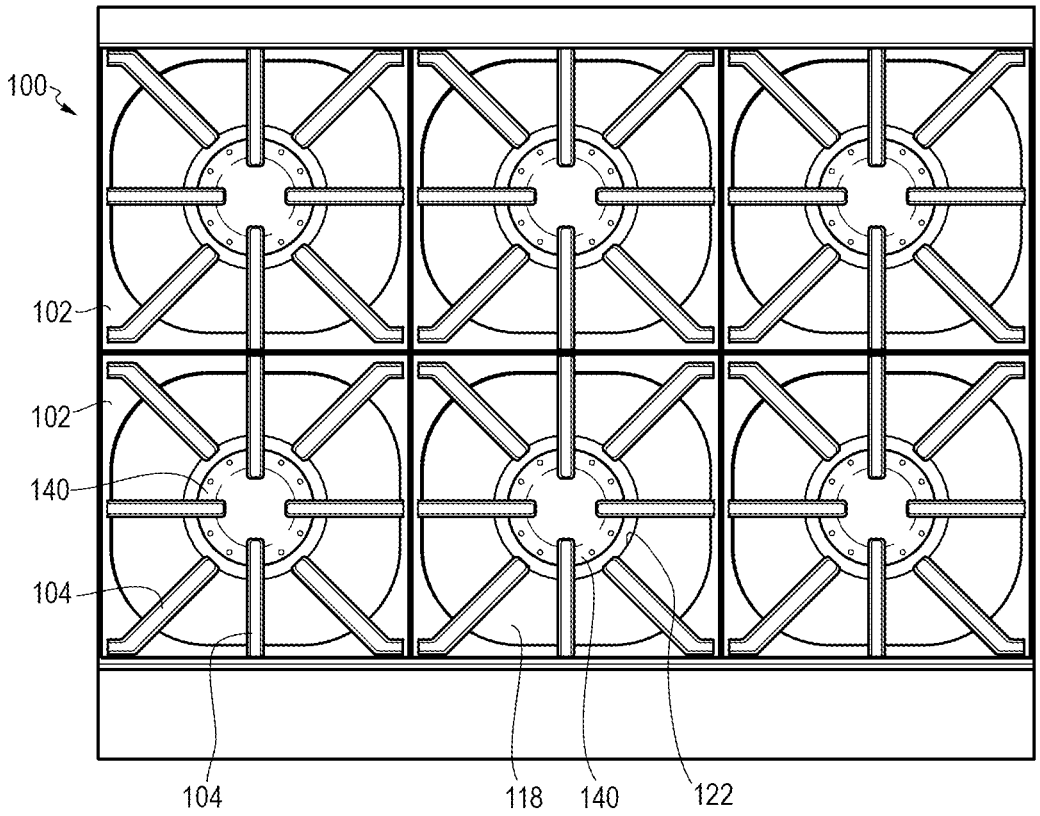
FIG. 1 PRIOR ART
FIG. 1 shows a prior art configuration of a grate with tangs extending from a proximal rim toward a central region above a burner element.
Figure 2:
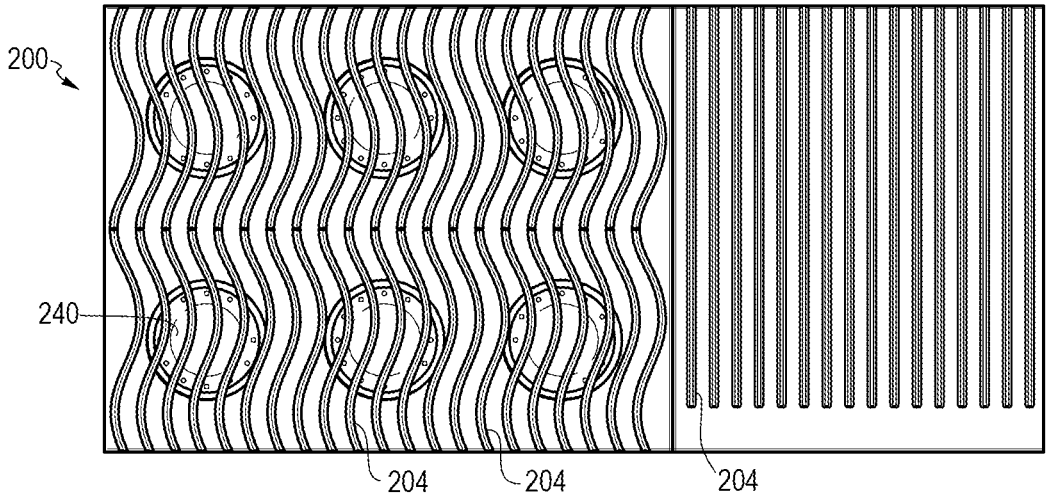
FIG. 2 PRIOR ART
FIG. 2 shows a prior art configuration of a grate with generally parallel fingers.
Figure 3:
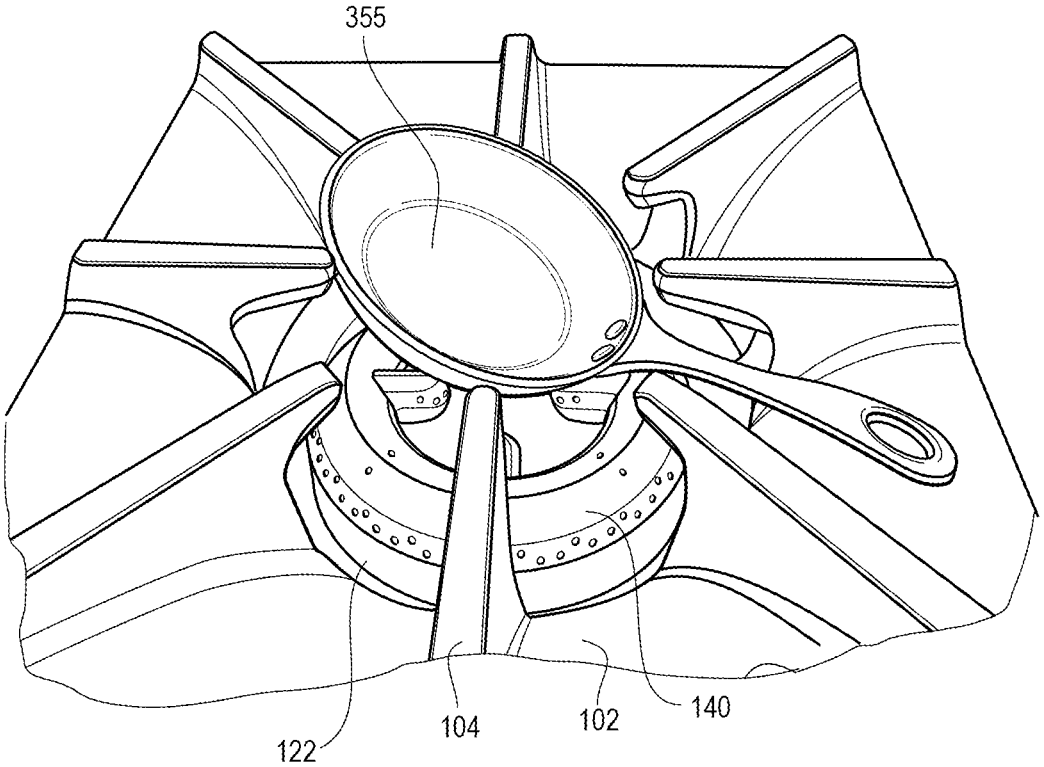
FIG. 3 PRIOR ART
FIG. 3 shows a prior art grate with a tipped skillet thereupon.

Various embodiments are described below with reference to the drawings in which like elements generally are referred to by like numerals. The relationship and functioning of the various elements of the embodiments may better be understood by reference to the following detailed description. However, embodiments are not limited to those illustrated in the drawings. It should be understood that the drawings are not necessarily to scale, and in certain instances details may have been omitted that are not necessary for an understanding of embodiments disclosed herein, such as—for example—conventional fabrication and assembly. However, in the present application, at least FIGS. 4-12B are drawn to scale, which—like any patent drawings—are exemplary, and do not limit the claimed scope unless specifically relied upon.

The present disclosure sets forth individual grates and a multi-grate system for a cooking range, wherein construction of the tangs and nubs of each grate are aligned with each other in a manner providing a non-contiguous surface along a common plane. The common plane is provided by the uppermost surfaces of the tangs and nubs upon which the bottom of a cooking vessel (e.g., stock pot, skillet, saucepan, griddle, etc.) rests. Existing grates typically require precise placement of a cooking vessel to keep it balanced and level on the grate surface, which is formed by the tangs or fingers that define the grate. Prior grates with radially disposed tangs (e.g., as in FIG. 1) have large enough gaps between the tangs that smaller cooking vessels will tip or even fall between them if not centered or nearly centered, but rather moved toward an edge of a grate and/or between adjacent grates, where the uppermost support surfaces provided are spaced more than three inches apart or even more than five inches apart. Accordingly, the relative and absolute positions and angles of the tangs and the nubs of the present disclosure provide advantages absent from the prior designs.

The invention is defined by the claims, may be embodied in many different forms, and should not be construed as limited to the embodiments set forth herein; rather, these embodiments are provided so that this disclosure will be thorough and complete, and will fully convey enabling disclosure to those skilled in the art. As used in this specification and the claims, the singular forms "a," "an," and "the" include plural referents unless the context clearly dictates otherwise.

The terms "proximal" and "distal" are used herein with reference to the border region of a single grate that defines its outer boundary, where the proximal end of a tang is mounted onto the border. The tang extends above the border and distally toward the center of the grate. The terms "about," "substantially," "generally," and other terms of degree, when used with reference to any volume, dimension, proportion, or other quantitative or qualitative value, are intended to communicate a definite and identifiable value within the standard parameters that would be understood by one of skill in the art, and should be interpreted to include at least any legal equivalents, minor but functionally-insignificant variants, standard manufacturing tolerances, and including at least mathematically significant figures (although not required to be as broad as the largest range thereof). The phrase "substantially co-planar" is used to mean that the item addressed (e.g., a planar disc of a given diameter-such as a bottom surface of a cooking vessel) will tip by no more than a 10 degree angle, and preferably by no more than a 5 degree angle relative to the plane of reference. Co-linear means disposed along a common straight line, such as co-linear tangs and co-linear nubs that are disposed along a common imaginary axis/line that goes through/across a center-point of a grate.

Figure 4:
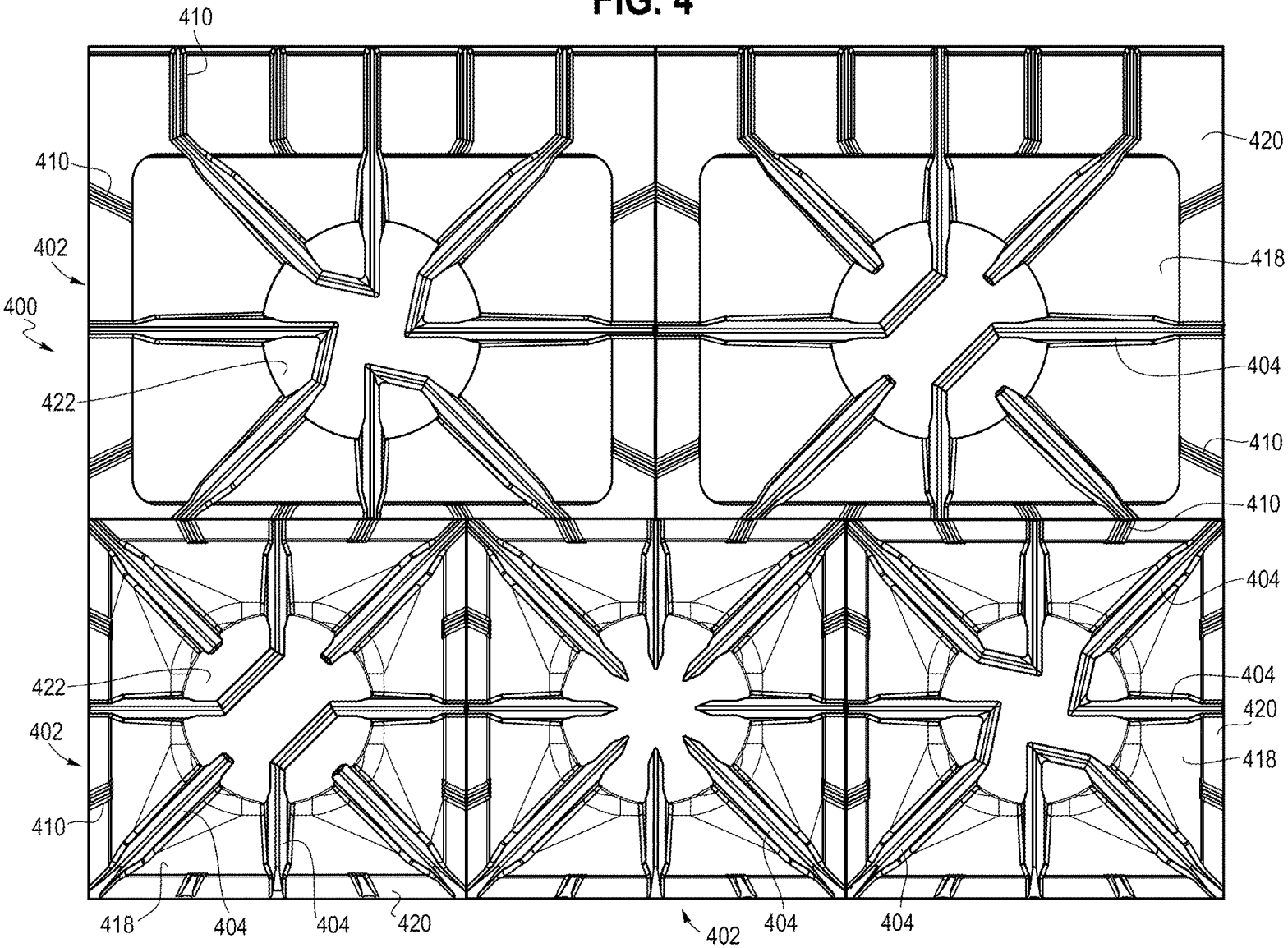
FIG. 4 shows a top plan view of a multi-grate array of a range including five grates of varied configuration.
Figure 5:
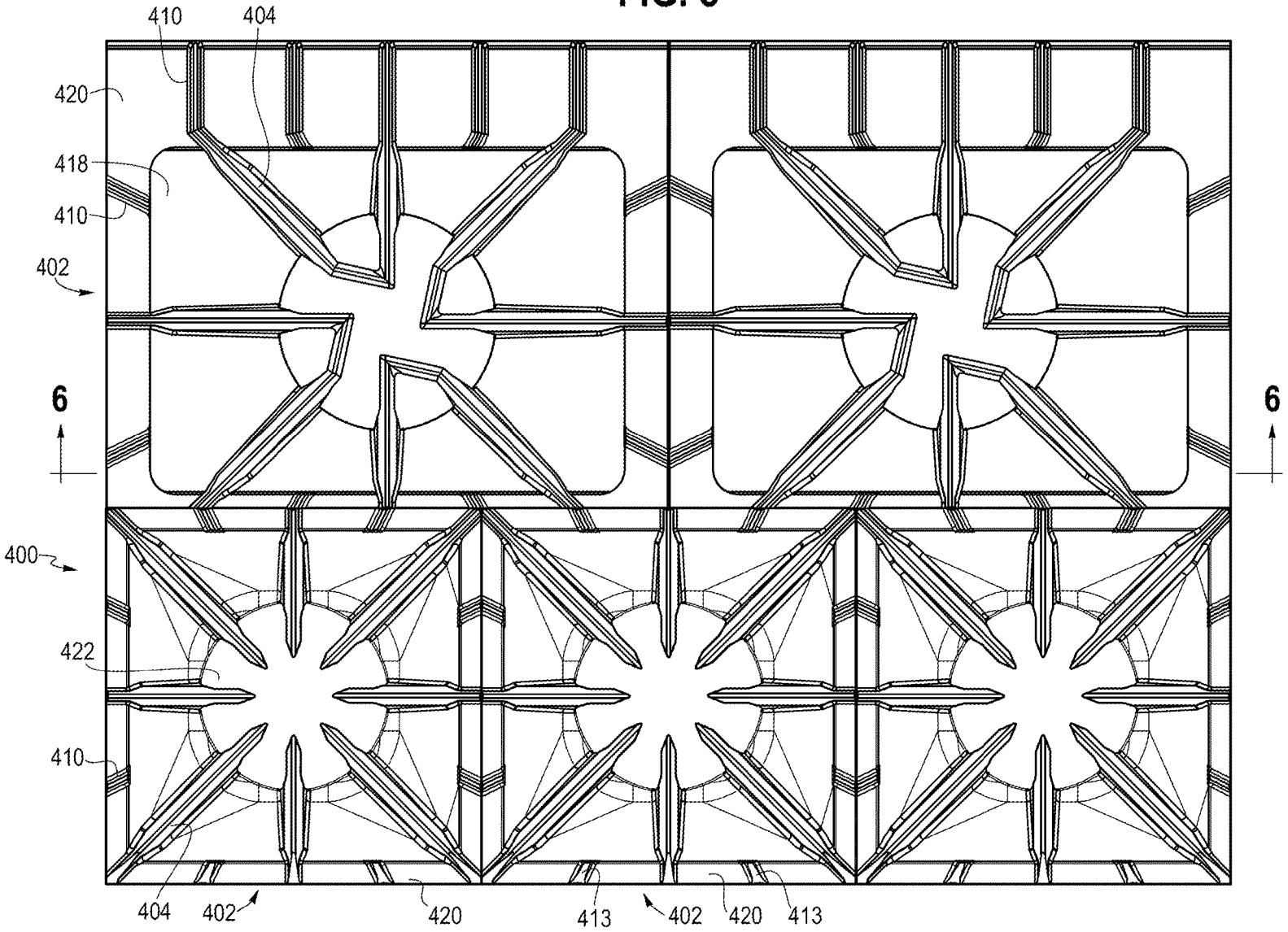
FIG. 5 shows a top plan view of a multi-grate array of a range including five grates of varied configuration, different than FIG. 4.
Figure 5A:
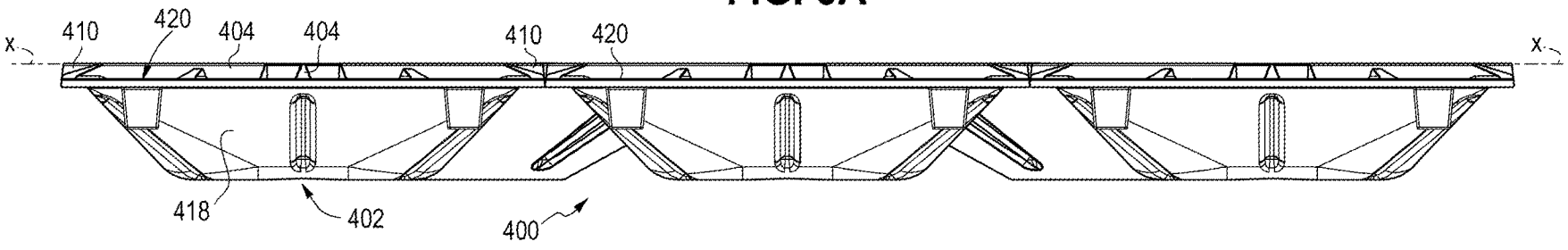
FIG. 5A shows a side elevation view of the multi-grate range of FIG. 5.
Figure 6:
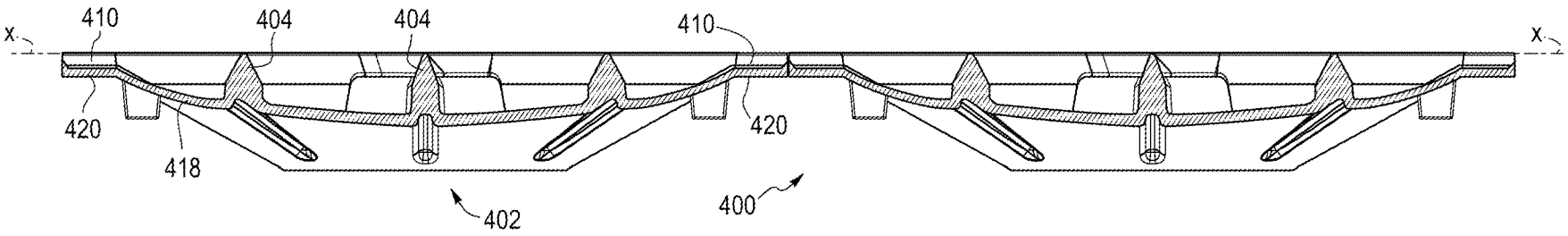
FIG. 6 shows a section view of the multi-grate range of FIG. 5, taken along line 6-6.

One embodiment of a multi-grate range 400 is described with reference to FIGS. 4-6. Three different grate configurations are shown in the top plan view of FIG. 4, although the specific aesthetic appearance of each configuration is not dictated by the functional limitations described here. Each grate 402 includes eight tangs 404 that extend distally from the platform border region 420 of a bowl 418 toward the center of the bowl. The central region of the concavity of the bowl 418 includes an aperture 422 for receiving a gas burner (not shown), which may be centered, or off-center relative to the bowl's concavity, the border 420, and/or the tangs 404. As shown in FIGS. 4, 5, and 6, the proximal ends of the tangs 404 protrude upward from the border region 420 of the bowl 418. The uppermost surface of each of the tangs 404 is coplanar with the uppermost surfaces of all the other tangs. Similarly, up to eight nubs 410 each protrude upward from the border region 420, where the nubs 410 are disposed alternatingly between each of the tangs 404. However, the nubs 410 do not project distally out from the border region 420 over the lower, concave portion of the bowl 418. The uppermost surface of each of the nubs 410 is coplanar with the uppermost surfaces of all the other nubs, as well as with the uppermost surfaces of all of the tangs 404. As such, the uppermost surfaces of the tangs 404 and the nubs 410 combine to form a non-contiguous surface along a common plane that is disposed above the bowl 418 including the border region 420 of the bowl. This plane is shown in FIGS. 5A and 6, designated by line X-X. In certain embodiments as illustrated, the grate configurations each consist of eight tangs and eight nubs (including nibs) with no other structures or surfaces contributing to the common plane, while in other embodiments the nubs along one or more edges of a grate may include a lip or wall that contributes surface(s) to the common plane (e.g., wall 1020*y* in FIG. 11A).

Figure 7:
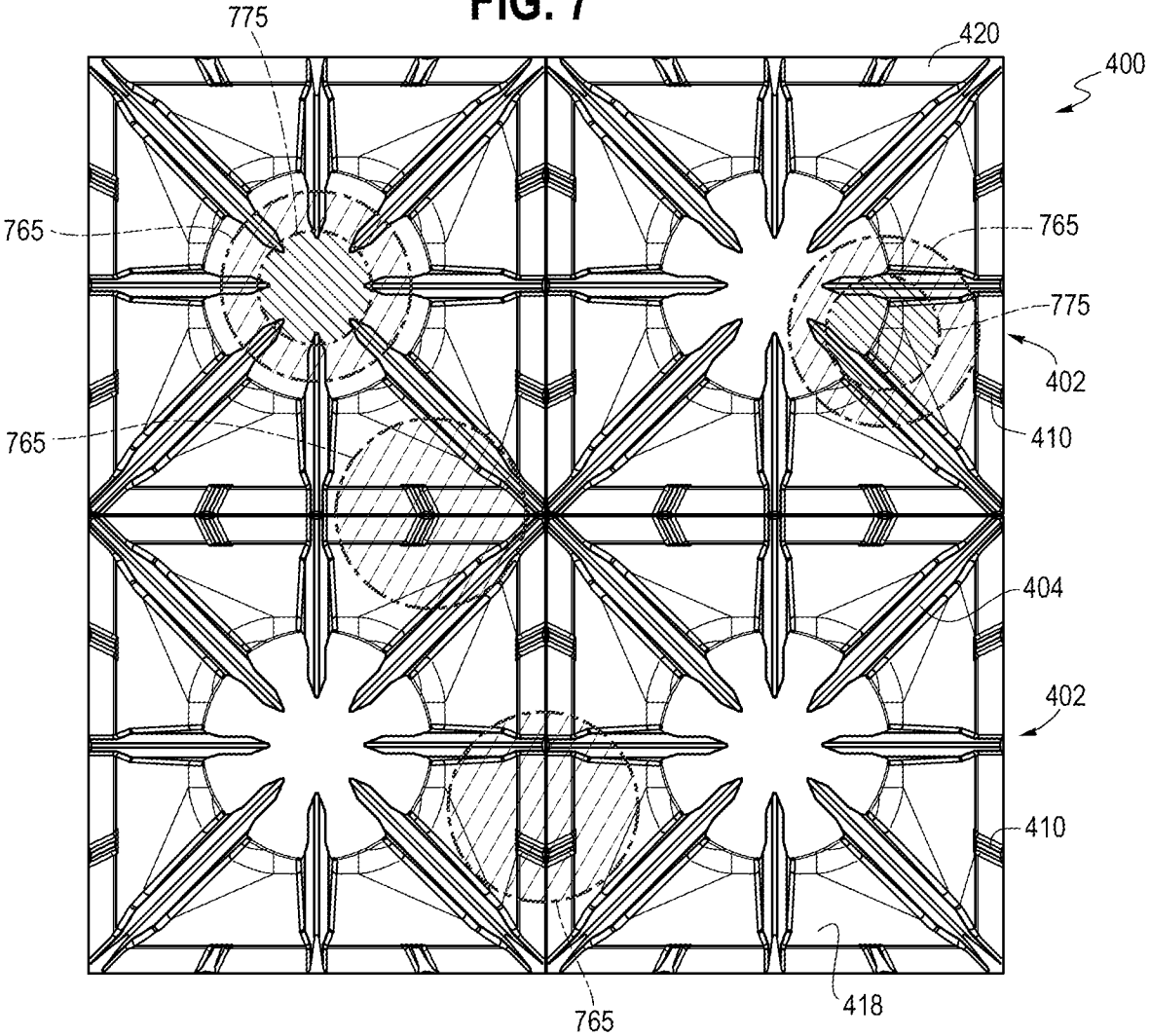
FIG. 7 shows a top plan view of a multi-grate array of a range including four grates each having the same configuration with dashed-line representations of two discs (of three-inch diameter and five-inch diameter) positioned to show contacts with tangs and/or nubs.

Notably, the uppermost surfaces of the tangs 404 and the nubs 410 are configured and disposed in proximity to each other such that a planar circle is positionable anywhere upon said uppermost surfaces in a manner preventing tipping of that planar circle (e.g., the bottom contact surface of a cooking vessel) by maintaining at least: three points of contact, two lines of contact, a point and a line of contact, or any combination thereof. As a result, and as illustrated in FIG. 7, a five-inch diameter planar circle, or even a three-inch diameter circle remains at least substantially coplanar with the common plane formed by the uppermost surfaces of the tangs 404 and nubs 410. This is also illustrated in FIGS. 10A-10B, 11A-11B, and 12A-12B. It should be noted that of the eight nubs shown, in some embodiments one, two, or another sub-plurality may be embodied as nibs 413 that are vertically slightly shorter than the nubs and tangs (e.g., along a front edge of the grate as in FIG. 5), over which the non-tipping functionality may be consistent or may allow for only slightly greater tipping than relative to the coplanar uppermost surfaces of the nubs and tangs. For example the uppermost surface of a nib may be between about 1% to about 35% lower than the uppermost surfaces of tangs 404 and nubs 410 as measured vertically from an uppermost surface of an outermost top boundary of the border 420 of a grate. Preferably the nib height, if lower, will not be different/lower enough to permit tipping of a five-inch diameter planar disc (or cooking vessel with that footprint) by more than ten degrees when the disc/vessel's center of mass is within a perimeter defined by the rectilinear outer boundary of the common plane.

Stated differently, in every contact position over a single grate and over a multi-grate array of a cooking range, a planar circle (e.g., the bottom surface of a cooking vessel) will always contact and rest upon some combination of linear and/or point surfaces of tangs and/or nubs sufficient to substantially prevent it from tipping because an uppermost surface of each nub and/or tang is within five inches of a nearest uppermost surface of another nub and/or tang (where substantially preventing tipping refers to less than ten degrees, preferably less than five degrees, and more preferably between level and two degrees). For the embodiments shown, this is applicable to a square or a non-square rectangular configuration of a rectilinear grate with dimensions of up to 18 inches by 18 inches, with a grate size preferably of at least 10 inches by 10 inches. This is further illustrated in FIGS. 5, 5A, and 6, where FIG. 5 shows a top plan view of a 5-burner configuration identifying a line of cross-section 6-6 from which FIG. 6 is viewed. In FIG. 6, and in FIG. 5A, which is side elevation view of FIG. 5, one can see the common plane as defined by both points and lines of the uppermost surfaces of the tangs and nubs. Not every grate shown will provide the tipping-prevention function focused upon herein, as—for example—if they are eighteen inches wide, the two larger-dimension grates in the upper portion of FIG. 5 may have a few positions where a five-inch disc would actually tip, but this is dependent upon the absolute dimensions of the grates and the dimensions between the novel tang and nub placements shown, which are not the only configurations providing the functional advantage.

In order to provide desirable efficiency of heating effectiveness by convection from an underlying burner and open space between the burner and an underside of a cooking vessel, a distal end portion of each tang is connected to no more than one distal portion of one other tang. This is shown in each of the three different embodiments of tang and nub configurations illustrated in FIG. 4, and shown alone in FIGS. 7, 8, and 9. In the embodiment of FIG. 7, none of the distal ends of tangs 404 are connected to each other. FIG. 7 also shows different positions of a five-inch disc 765 and a three-inch disc 775, including how each of those positions provides at least three points of contact, two lines of contact, at least one point and at least line of contact, or any other combination of points and/or lines of contact with one or more tangs 404 and/or nubs 410 in different positions on the range. Each of those positions is sufficiently supported that a cooking vessel of that size would not substantially tip and might not tip at all.

Figure 8:
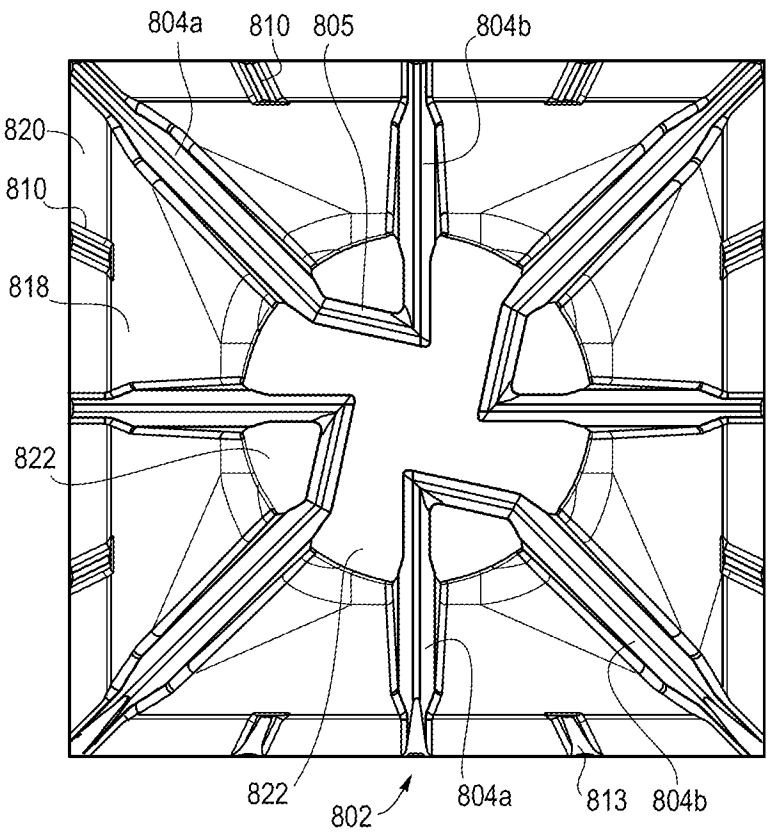
FIG. 8 shows a top plan view of a single grate embodiment with connected tangs.
Figure 10A:
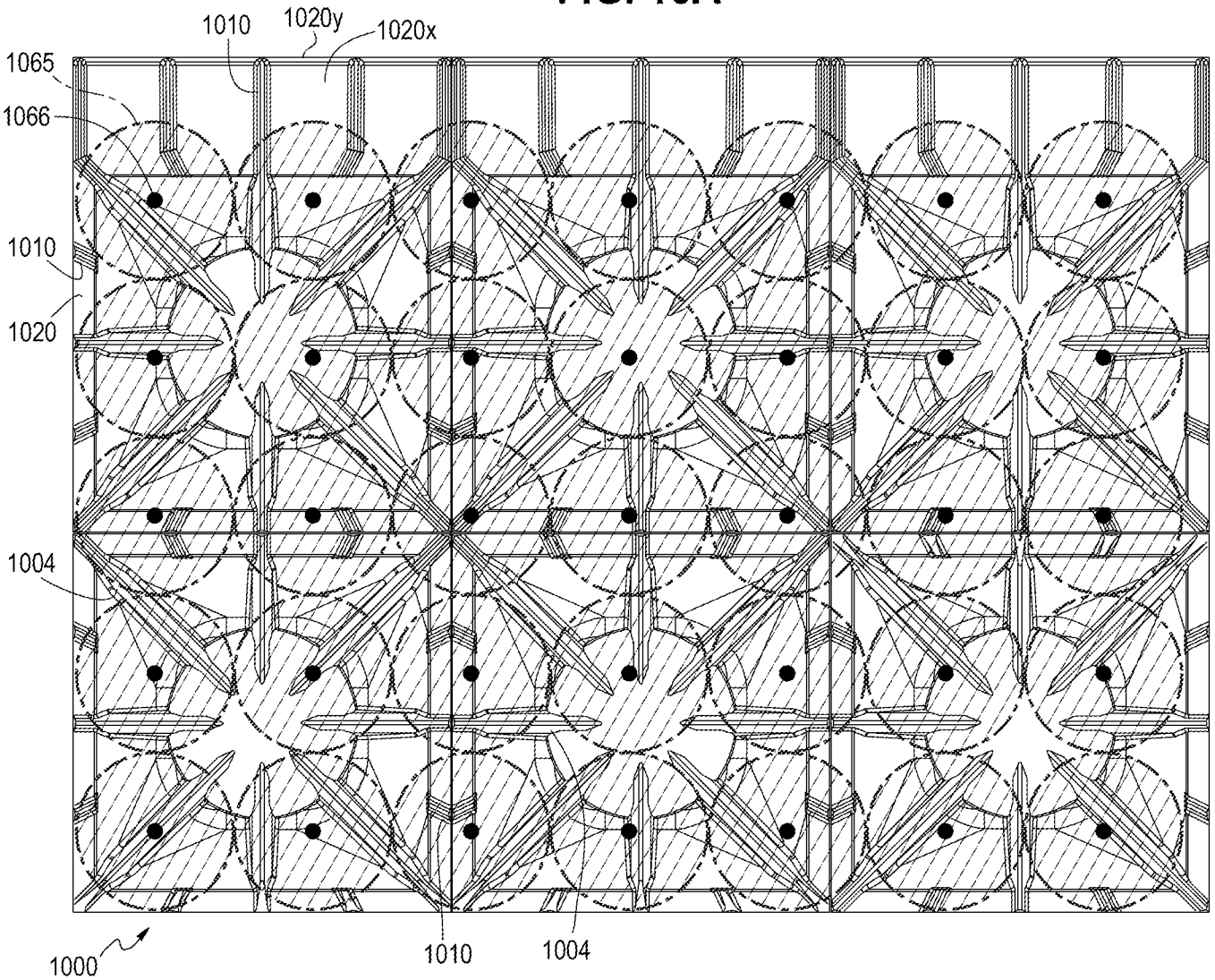
FIGS. 10A-10B show the balancing (i.e., tipping prevention) function of a multi-grate range from a top plan view for one grate configuration.
Figure 10B:
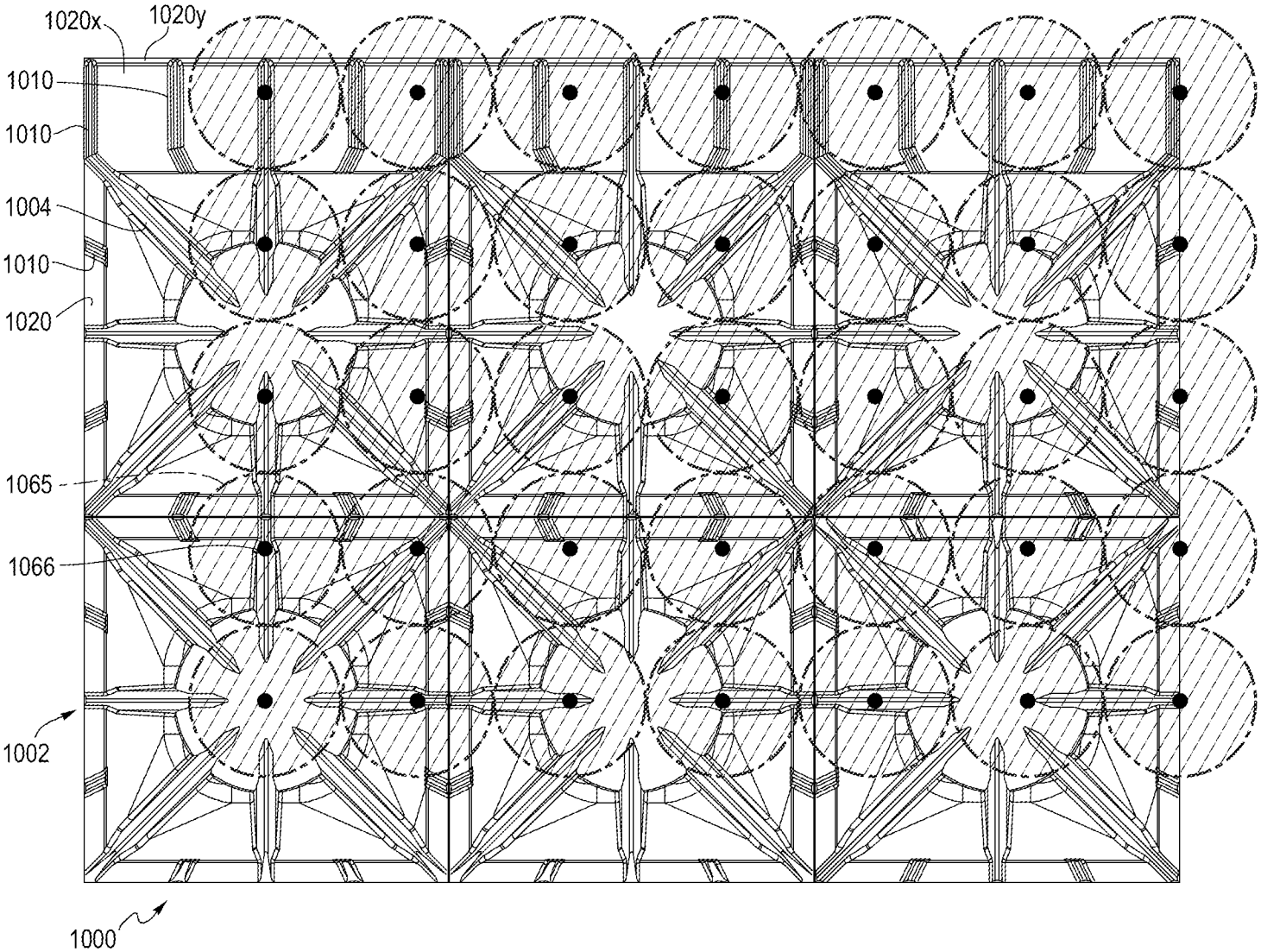
Figure 11A:
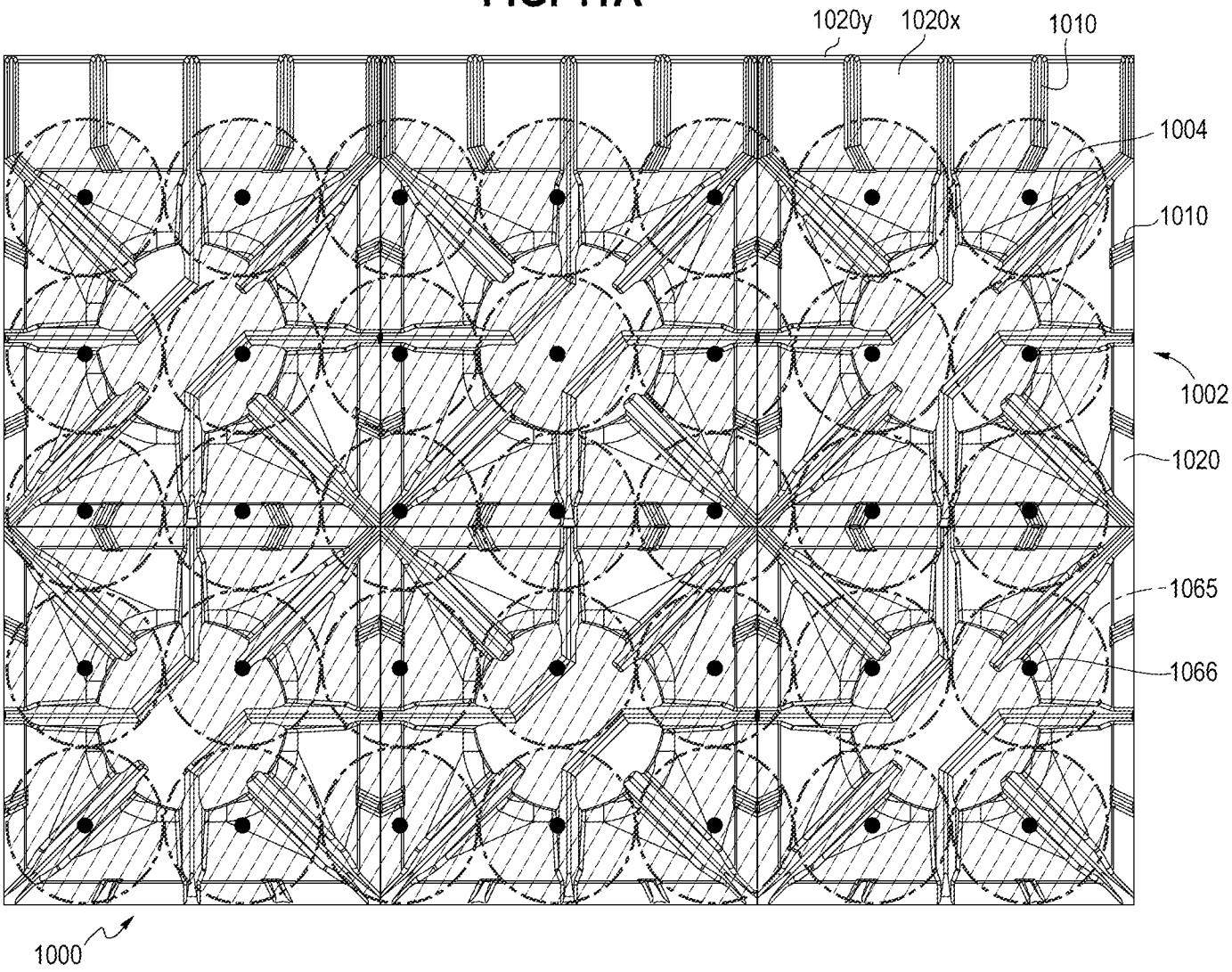
FIGS. 11A-11B show the balancing (i.e., tipping prevention) function of a multi-grate range from a top plan view for another grate configuration.
Figure 11B:
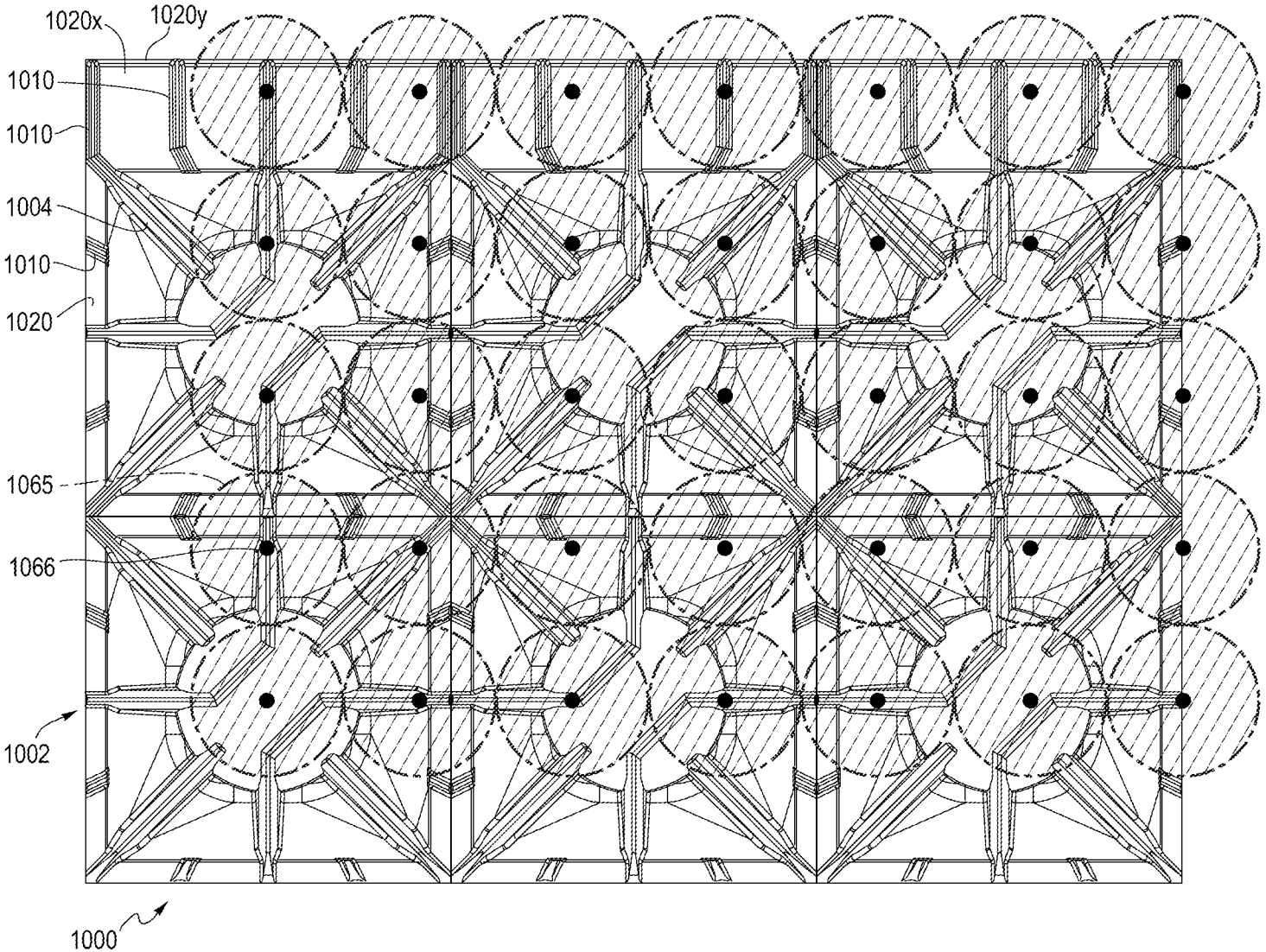
Figure 12A:
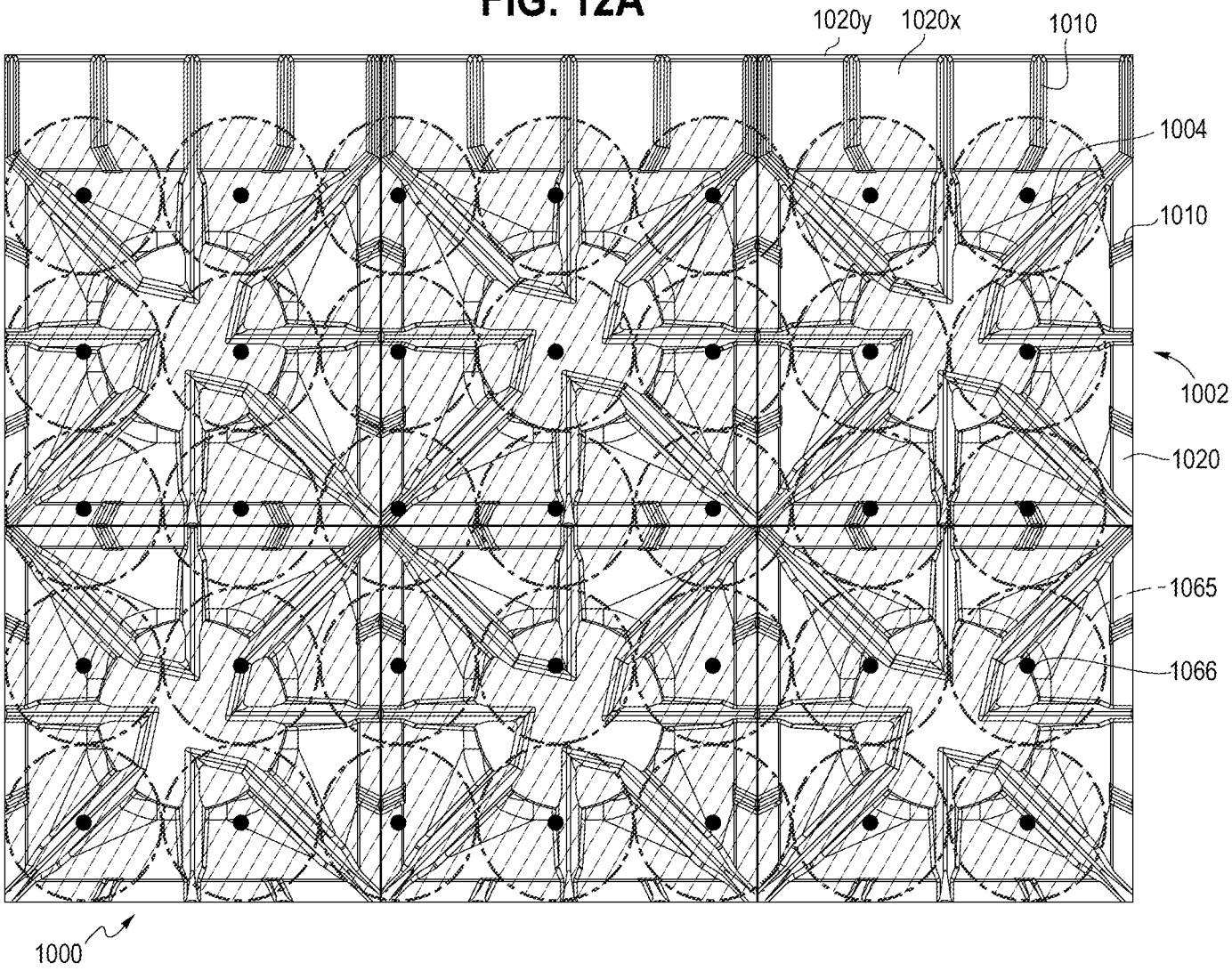
FIGS. 12A-12B show the balancing (i.e., tipping prevention) function of a multi-grate range from a top plan view for yet another grate configuration.
Figure 12B:
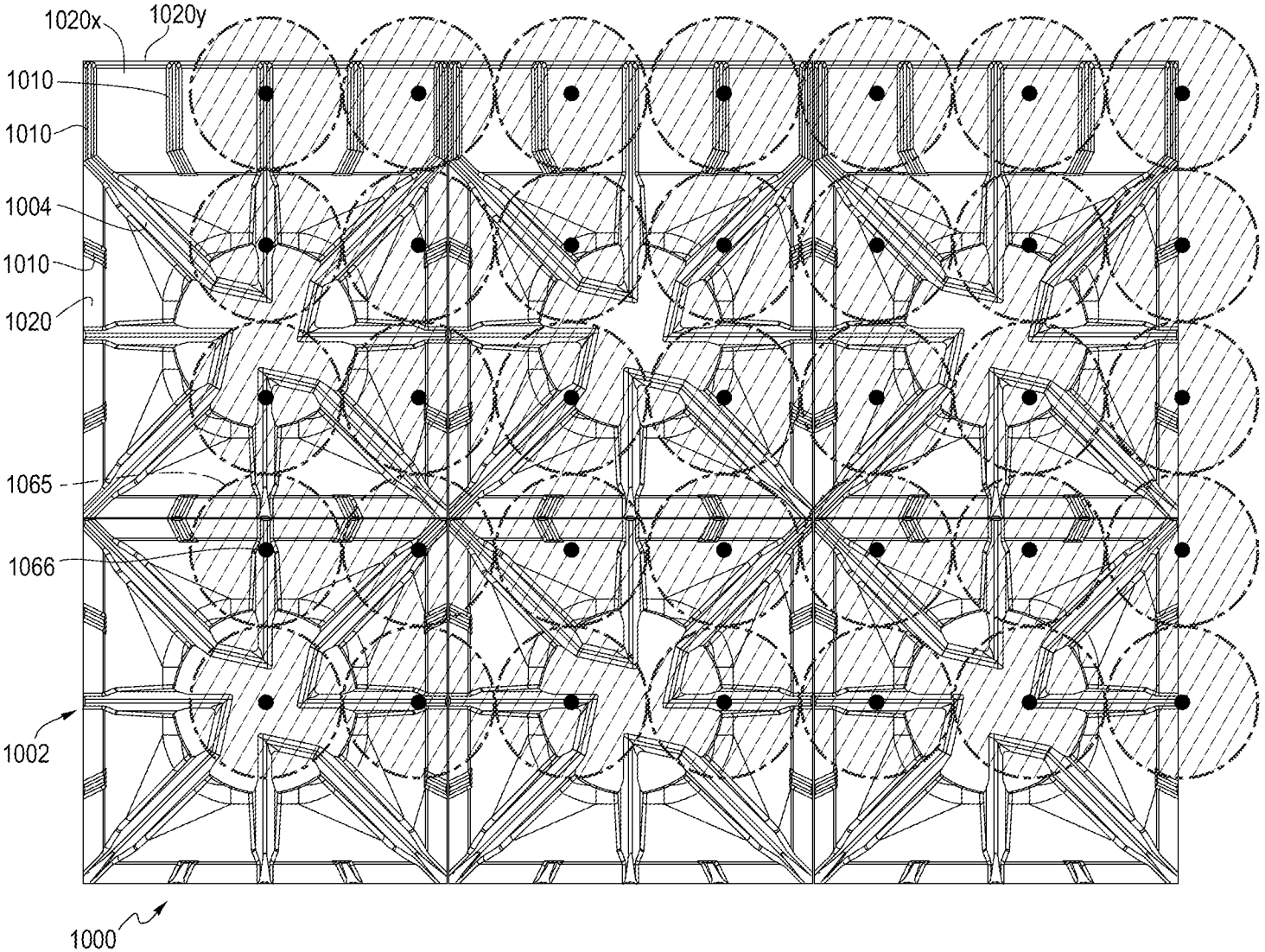

A connected-tang grate embodiment 802 is shown in FIG. 8. A distal end portion of a first tang 804*a* is connected to a distal end portion of a second tang 804*b* by an inter-tang length 805 that is not co-linear with the first tang 804*a* nor with the second tang 804*b*. Here, the first tang 804*a* is adjacent to the second tang 804*b*, separated by one intervening nub 810 (or nib 813) on the border region 820 of the bowl 818. Because the connected tangs are not co-linear, no tang nor inter-tang length crosses over the center-point of the grate defined by the bowl aperture 822. However, as with the embodiments described and illustrated above, the uppermost surfaces of the tangs (including 804*a*, 804*b*, and the inter-tang lengths 805) and the nubs 810 are all aligned to form a common non-contiguous plane just like the plane X-X of FIGS. 5A and 6, whereupon a vessel in contact with the coplanar surfaces will remain balanced without substantially tipping when the vessel's center of mass is within a perimeter defined by the rectilinear outer boundary of the common plane.

Figure 9:
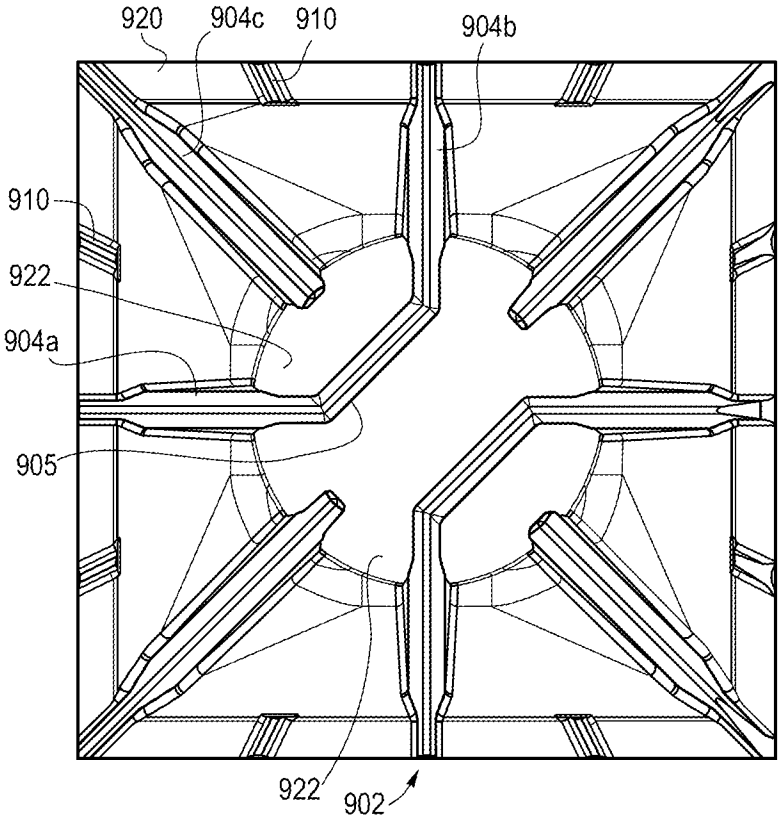
FIG. 9 shows a top plan view of a single grate embodiment with connected tangs configured differently than FIG. 8.

Likewise, in the grate embodiment 902 of FIG. 9, a distal end portion of a first tang 904*a* is connected to a distal end portion of a second tang 904*b* by an inter-tang length 905 that is not co-linear with the first tang 904*a* nor with the second tang 904*b*. Because the connected tangs are not co-linear, no tang nor inter-tang length crosses over the center-point of the grate defined by the bowl aperture 922. Here, the first tang 904*a* is not adjacent to the second tang 904*b*, being separated by a longitudinally shorter tang 904*c* and two intervening nubs 910 on the border region 920. It should be appreciated that, for a multi-grate range, different grate configurations described herein can be combined in any manner including those with and without connected tangs. Furthermore, for a multi-grate range of the present disclosure, some embodiments may include as few as one or two grates that provide the structure and function preventing tipping, while other grates of the multi-grate range may not, but such a range could still be within the scope of the present disclosure. The same ability to mix and/or match features disclosed and claimed further applies to tapering of tangs and/or nubs.

Another means of increasing the open area between a burner and the underside of a cooking vessel resting on the common plane is to decrease the surface area of the uppermost surfaces of the tangs. This is done in the illustrated embodiments by providing a tapered surface as illustrated, which includes a robust construction for durability with reference to a broader base and mounting to the lower/concave surfaces of the bowl. The tapering can achieve the same or similar functional advantages while being configured differently than the "house-shaped" taper illustrated (e.g., hemispherically rounded, ogive, including more or fewer chamfered or otherwise angled surfaces, parabolic etc.).

As shown in FIGS. 4 and 7, the proximal ends of at least two or more of the tangs and/or nubs of each grate are aligned with and directly/closely near to proximal ends of at least two or more of the tangs and/or nubs of each immediately adjacent grate, so that the common plane of the each grate is continuous and coplanar with the common plane(s) of the other grate(s). It should expressly be appreciated that the three different nub and tang configurations here are not considered to exhaust the entire scope for providing the claimed functionally-limited structure. Also, it should be expressly appreciated that these three different configurations can be mixed and matched in different numbers and combinations as shown in FIG. 4, where different tang/nub configurations can be used together on the same range top as can different sizes, subject to the construction dimensions and burner positioning/placement on the range. It should be noted that FIGS. 4-12B do not illustrate a gas burner in order to keep the drawings of each grate clearer and simpler.

FIGS. 10A-10B, 11A-11B, and 12A-12B show examples of multi-grate range tops 1000, each with different tang configurations. These are illustrated with 12-inch by 12-inch square grates 1002, including how a five-inch disc 1065 (e.g., the bottom surface of a typical 7-inch diameter skillet, or the 5-inch diameter of any other circular-profile cooking vessel) will fit and balance on and/or across at least three points of contact, two lines of contact, at least one point and at least line of contact, or any other combination of points and/or lines of contact. The center of mass for each of those circles 1065 is shown by a solid black dot 1066, which—as illustrated-provides for support sufficient to substantially prevent tipping for the positions shown because of the contacts between the discs and some combination of tangs 1004 and/or nubs 1010. This functionality may be provided with grates having larger or smaller absolute dimensions, although it is intended for the present novel embodiments that the grates be at least ten inches wide or long (and preferably at least a ten-inch square), as even traditional and well-known grate configurations would support a five-inch disc/cooking vessel in nearly all centered positions for grates that are eight-inch square or smaller. It should be understood that the grate dimensions will be within manufacturing tolerances of +/−one-eighth inch, and preferably within +/−one-sixteenth inch.

In the illustrated embodiments of FIGS. 10A-12B, with different nub and tang configurations shown, the tipping-prevention functionality is present when the center of mass of the disc (as proxy for any vessel or other object being balanced) is within a perimeter defined by the rectilinear outer boundary of the common plane of each grate as defined by the coplanar uppermost surfaces of its tangs and nubs, and of the multi-grate array of the range—also within a perimeter defined by the coplanar uppermost surfaces of the tangs and nubs of the individual grates making up the array. It should be noted that, along the rear perimeter of the multi-grate ranges shown in FIGS. 10A-12B, a border region 1020*x* is present that is broader than the rest of the grate border regions 1020 with longer—but not taller—nubs 1010 and that includes a raised boundary wall 1020*y* configured at the same height as (that is, has its uppermost surface aligned coplanar with the common plane of) the tangs 1004 and nubs 1010 shown. In view of the present disclosure, those of skill in the art are provided with sufficient teaching to configure other tang and nub combinations with the non-tipping functionality, including for a disc (e.g., cooking vessel bottom) as small as three inches in diameter. Also, in FIGS. 10A-12B, the freestanding tangs 1004 are not numbered differently from each other, as the tipping-prevention functionality is the same for each of the different configurations.

Those of skill in the art will appreciate that embodiments not expressly illustrated herein may be practiced within the scope of the claims, including that features described herein for different embodiments may be combined with each other and/or with currently-known or future-developed technologies while remaining within the scope of the claims. Although specific terms are employed herein, they are used in a generic and descriptive sense only and not for purposes of limitation unless specifically defined by context, usage, or other explicit designation. It is therefore intended that the foregoing detailed description be regarded as illustrative rather than limiting. And, it should be understood that the following claims, including all equivalents, are intended to define the spirit and scope of this invention. Furthermore, the advantages described above are not necessarily the only advantages of the invention, and it is not necessarily expected that all of the described advantages will be achieved with every embodiment. In the event of any inconsistent disclosure or definition from the present application conflicting with any document incorporated by reference, the disclosure or definition herein shall be deemed to prevail.

I claim:

1. A first grate for a cooking range, said grate comprising:

a bowl including a rectilinearly-bounded border region which border is at least ten inches long or wide;

a set of eight tangs protruding upward from and extending distally from the border region generally toward a central region above the bowl; and a set of at least six nubs protruding upward from the border region and disposed alternatingly between at least six of the eight tangs;

where an uppermost surface of each of the tangs and an uppermost surface of each of the nubs together forms a non-contiguous surface along a common plane that is disposed above the bowl including the border region of the bowl;

wherein the uppermost surfaces of the tangs and the nubs are configured and disposed in proximity to each other such that a five-inch diameter planar circle is positionable anywhere upon said uppermost surfaces in a manner preventing tipping by maintaining at least three points of contact, two lines of contact, at least one point and at least line of contact, or any other combination of points and/or lines of contact, so that the five-inch diameter planar circle remains at least substantially coplanar with the common plane; and where a wall is configured and disposed in proximity to the tangs and the nubs, with an uppermost surface of the wall disposed along the common plane such that a five-inch diameter planar circle is positionable anywhere upon the uppermost surfaces of one or more of the wall, tangs, and nubs in a manner preventing tipping by maintaining at least three points of contact, two lines of contact, at least one point and at least line of contact, or any other combination of points and/or lines of contact, so that the five-inch diameter planar circle remains at least substantially coplanar with the common plane.

2. The first grate of claim 1, wherein the uppermost surface of at least one tang or at least one nub is narrower than its lowermost surface, thereby providing a tapered transverse sectional profile for said at least one tang or at least one nub.

3. The first grate of claim 1, wherein the first and second tangs are not adjacent to each other, but are separated by one intervening tang and two intervening nubs on the border region, or wherein the first and second tangs are adjacent to each other, separated by one intervening nub on the border region.

4. A first grate for a cooking range, said grate comprising:

a bowl including a rectilinearly-bounded border region which border is at least ten inches long or wide;

a set of eight tangs protruding upward from and extending distally from the border region generally toward a central region above the bowl; and a set of at least six nubs protruding upward from the border region and disposed alternatingly between at least six of the eight tangs;

where an uppermost surface of each of the tangs and an uppermost surface of each of the nubs together forms a non-contiguous surface along a common plane that is disposed above the bowl including above the border region of the bowl;

wherein the uppermost surfaces of the tangs and the nubs are configured and disposed in proximity to each other such that a five-inch diameter planar circle is positionable anywhere upon said uppermost surfaces in a manner preventing tipping by maintaining at least three points of contact, two lines of contact, at least one point and at least one line of contact, or any other combination of points and/or lines of contact, so that the five-inch diameter planar circle remains at least substantially coplanar with the common plane;

wherein the uppermost surface of at least one of the tangs or at least one of the nubs is narrower than its respective lowermost surface, thereby providing a tapered transverse sectional profile for said at least one of the tangs or at least one of the nubs;

wherein a distal end of at least one of the tangs is narrower than a proximal end of that at least one of the tangs; and where a wall is configured and disposed in proximity to the tangs and the nubs, with an uppermost surface of the wall disposed along the common plane such that a five-inch diameter planar circle is positionable anywhere upon the uppermost surfaces of one or more of the wall, tangs, and nubs in a manner preventing tipping by maintaining at least three points of contact, two lines of contact, at least one point and at least line of contact, or any other combination of points and/or lines of contact, so that the five-inch diameter planar circle remains at least substantially coplanar with the common plane.

5. The first grate of claim 4, where an aperture for receiving a gas burner is off-center relative to a concavity of the bowl.

6. The first grate of claim 4, wherein one or more nibs is disposed protruding upward from the border region between two of the tangs, where said nib(s) have an uppermost surface height that is below the common plane.

7. A gas range comprising at least one first grate according to claim 4, and further comprising at least one gas burner.

8. A gas range comprising at least the first grate according to claim 4 and at least a second grate configured according to claim 4.

9. A gas range according to claim 8, wherein proximal ends of at least two or more of the tangs and/or nubs of the first grate are aligned with and adjacent to proximal ends of at least two or more of the tangs and/or nubs of the second grate, and where the common plane of the first grate is continuous and coplanar with a common plane of the second grate.

10. A gas range according to claim 9, further comprising at least a third grate, wherein proximal ends of at least two or more of the tangs and/or nubs of the third grate are aligned with and adjacent to proximal ends of at least two or more of the tangs and/or nubs of the first grate, or at least two or more of the tangs and/or nubs of the second grate, or at least two or more of the tangs and/or nubs of the first grate and of the second grate, and where the common plane of the first grate is continuous and coplanar with a common plane of the second grate and a common plane of the third grate.

11. A gas range according to claim 8, further comprising at least a third grate.

12. A gas range according to claim 11, where the nubs and tangs are configured such that a five-inch diameter planar circle is positionable anywhere upon said uppermost surfaces in a manner preventing tipping by maintaining at least three points of contact, two lines of contact, at least one point and at least line of contact, or any other combination of points and/or lines of contact, so that the five-inch diameter planar circle remains at least substantially coplanar with the common plane of the first grate and second grate when a center of mass is within a perimeter defined by the rectilinearly-bounded border region.

13. A gas range according to claim 11, where the nubs and tangs are configured such that a three-inch diameter planar circle is positionable anywhere upon said uppermost surfaces in a manner preventing tipping by maintaining at least three points of contact, two lines of contact, a point and a line of contact, or any combination thereof, so that the three-inch diameter planar circle remains at least substantially coplanar with the common plane of the grates.

14. A multi-grate system for a gas cooking range, said multi-grate system comprising at least one first grate according to claim 4, and further comprising:

a plurality of grates with each grate having at least one edge abutting at least one edge of another grate;

wherein a second grate of the plurality of grates each comprises:

a bowl including a rectilinearly-bounded border region outwardly defining the edges of each grate;

a set of eight tangs protruding upward from and extending distally from the border region generally toward a central region above the bowl; and a set of at least six nubs protruding upward from the border region and disposed alternatingly between at least six of the eight tangs;

where an uppermost surface of each of the tangs and an uppermost surface of each of the nubs are aligned so as to form a non-contiguous surface along a common plane that is disposed above the bowl; and wherein the uppermost surfaces of the tangs and the uppermost surfaces of the nubs are configured and disposed in proximity to each other such that a five-inch diameter planar circle is positionable anywhere upon said uppermost surfaces in a manner preventing tipping by maintaining at least three points of contact, two lines of contact, a point and a line of contact, or any combination thereof, so that the five-inch diameter planar circle remains at least substantially coplanar with the common plane in any position atop the uppermost surfaces of the plurality of grates.

15. The multi-grate system of claim 14, wherein at least one of the plurality of grates has a larger surface area or a smaller surface area, defined by its rectilinear boundary, as compared to another of the plurality of grates.

16. The multi-grate system of claim 14, wherein the non-contiguous surface along the common plane is defined by outermost ends of the tangs and the nubs, along with at least one line and/or at least one point of the uppermost surface of the wall.

17. The multi-grate system of claim 16, wherein the non-contiguous surface along the common plane for a single grate is bounded by a square or is bounded by a non-square rectangle.

18. The multi-grate system of claim 14, where a distal end portion of each tang is connected to no more than one distal portion of one other tang.

19. The multi-grate system of claim 14, wherein a distal end portion of a first tang is connected to a distal end portion of a second tang by an inter-tang length that is not co-linear with the first tang nor with the second tang.

* * * * *